US012799702B2

(12) United States Patent
Blieux et al.

(10) Patent No.: US 12,799,702 B2
(45) Date of Patent: Nov. 17, 2026

(54) DEVICE FOR ACCESSING AN UNDERGROUND FACILITY, COMPRISING AN ADJUSTABLE ASSISTANCE CYLINDER

(71) Applicant: EJ EMEA, Saint-Crépin-Ibouvillers (FR)

(72) Inventors: Alex Blieux, Saint-Felix (FR); Viktor Groz, Saint-Crepin-Ibouvillers (FR)

(73) Assignee: EJ EMEA, Saint-Crépin-Ibouvillers (FR)

( * ) Notice: Subject to any disclaimer, the term of this patent is extended or adjusted under 35 U.S.C. 154(b) by 620 days.

(21) Appl. No.: 18/261,789

(22) PCT Filed: Jan. 13, 2022

(86) PCT No.: PCT/FR2022/050066

§ 371 (c)(1),
(2) Date: Jul. 17, 2023

(87) PCT Pub. No.: WO2022/153008

PCT Pub. Date: Jul. 21, 2022

(65) Prior Publication Data

US 2025/0075461 A1 Mar. 6, 2025

(30) Foreign Application Priority Data

Jan. 18, 2021 (FR) ..... 2100431
Oct. 18, 2021 (FR) ..... 2111056

(51) Int. Cl.
*E02D 29/14* (2006.01)

(52) U.S. Cl.
CPC ..... *E02D 29/1418* (2013.01)

(58) Field of Classification Search
CPC ..... E02D 29/1418; E05F 1/1058
(Continued)

(56) References Cited

U.S. PATENT DOCUMENTS 6,446,307 B2 * 9/2002 Wilkins ..... E02D 29/1463 49/237
6,557,300 B1 * 5/2003 Bantle ..... E05F 1/1058 16/70

(Continued)

FOREIGN PATENT DOCUMENTS

ES 2552092 T3 * 11/2015 ..... E05C 17/16
FR 2787476 A1 6/2000

(Continued)

OTHER PUBLICATIONS

International Search Report w/English translation for PCT/FR2022/050066 mailed May 9, 2022, 5 pages.

(Continued)

*Primary Examiner* — Gary S Hartmann
(74) *Attorney, Agent, or Firm* — NIXON & VANDERHYE

(57) ABSTRACT

A device and method for accessing an underground facility includes a frame forming an opening and a lid pivotally mounted relative to the frame. The device includes a mechanical cylinder with a helical spring, the cylinder including a body which can vary in length according to a longitudinal force which is applied thereto. The device is configured so that the cylinder assists the passage of the lid from the closed position to the open position and exerts on the lid a force opposing closure thereof during passage thereof from the open position to its closed position. The cylinder includes an adjustable head connected to one end of the body of the cylinder and a mechanism for adjusting the longitudinal position of the adjustable head with respect to the body of the cylinder.

19 Claims, 6 Drawing Sheets

(58) Field of Classification Search
USPC ..... 404/25
See application file for complete search history.

(56) References Cited

U.S. PATENT DOCUMENTS

| | | | | |
|---|---|---|---|---|
| 9,021,743 | B2 * | 5/2015 | Piermee | E05F 1/105 16/289 |
| 12,037,830 | B2 * | 7/2024 | D'Allesandro | E05F 1/1253 |
| 2011/0278778 | A1 | 11/2011 | Qattan | |

FOREIGN PATENT DOCUMENTS

| | | | | |
|---|---|---|---|---|
| FR | 2972476 | A1 | 9/2012 | |
| WO | 2013110636 | A1 | 8/2013 | |
| WO | WO-2016092175 | A1 * | 6/2016 | E02D 29/1418 |

OTHER PUBLICATIONS

Written Opinion of the ISA for PCT/FR2022/050066 mailed May 9, 2022, 6 pages.

* cited by examiner

[Fig. 1]
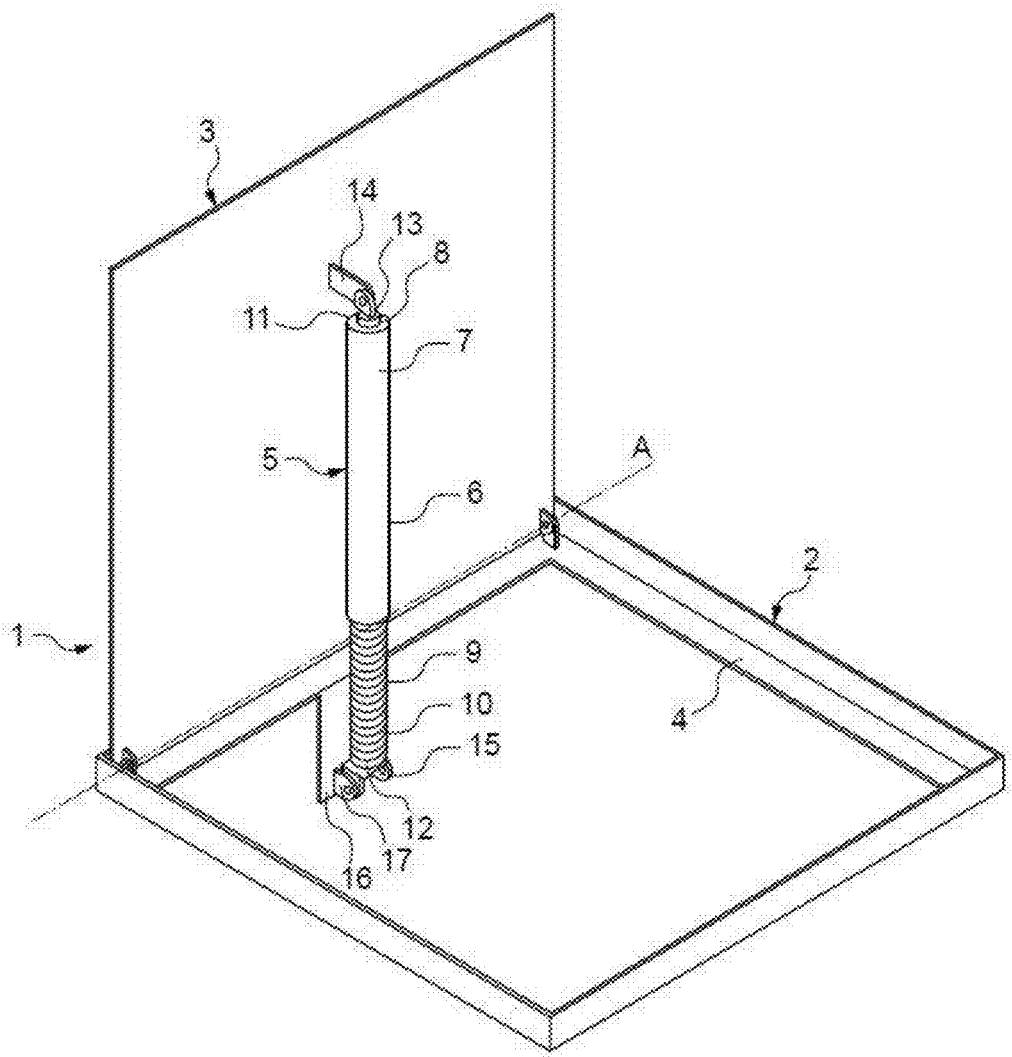

[Fig. 2]
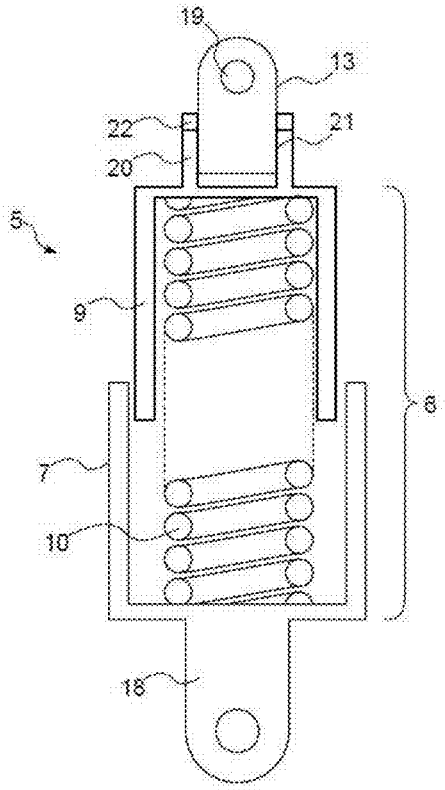
[Fig. 3]
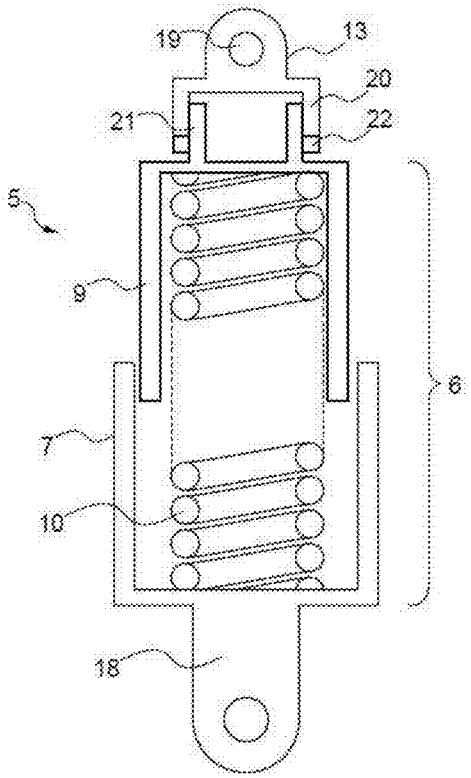

[Fig. 4]
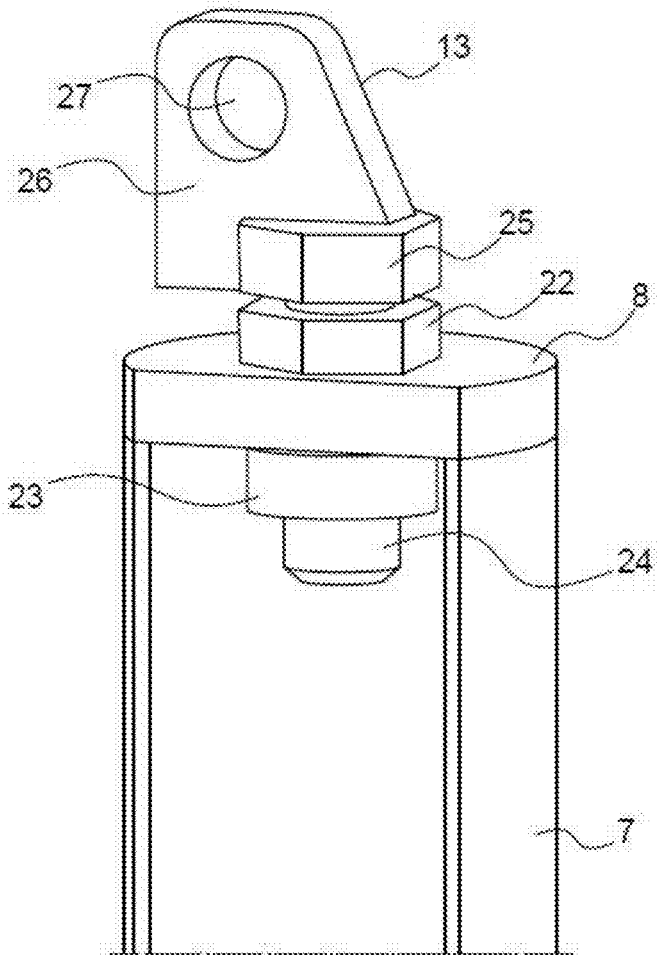

[Fig. 5]
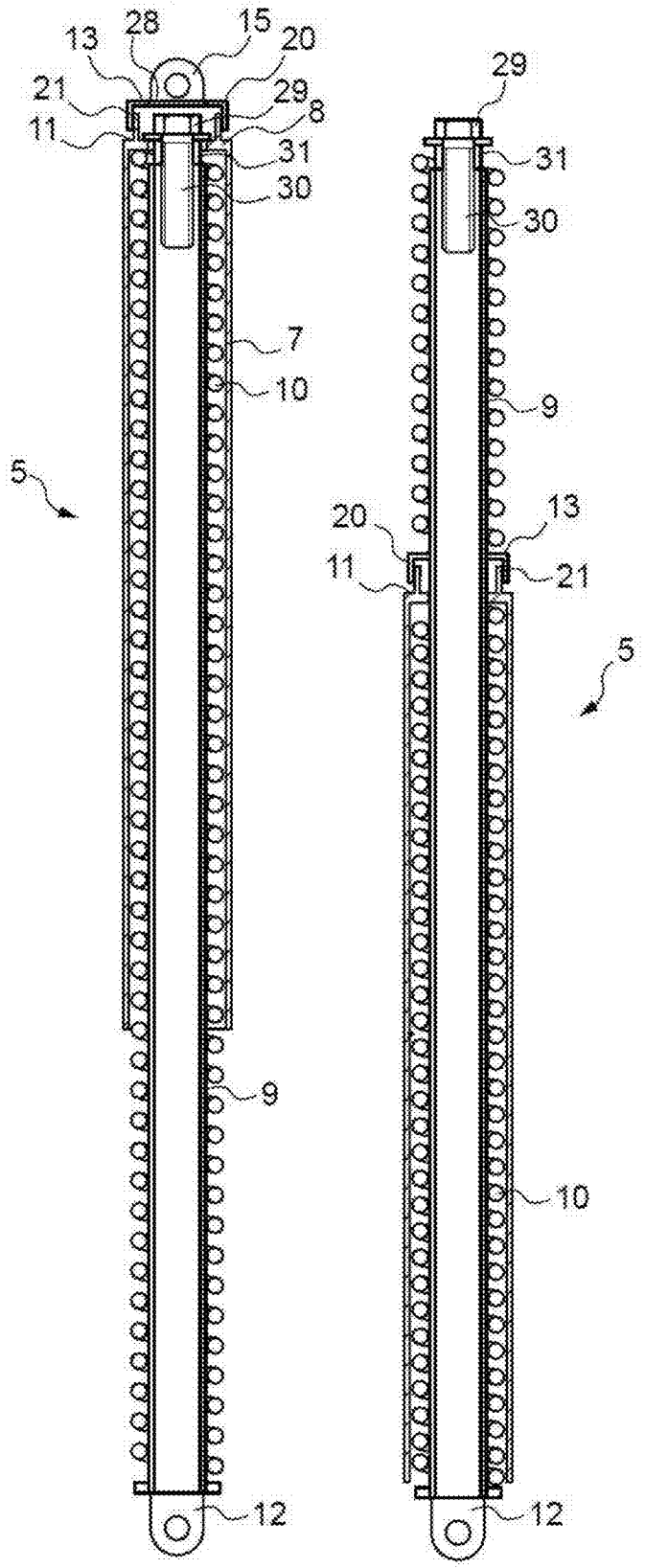

[Fig. 6]
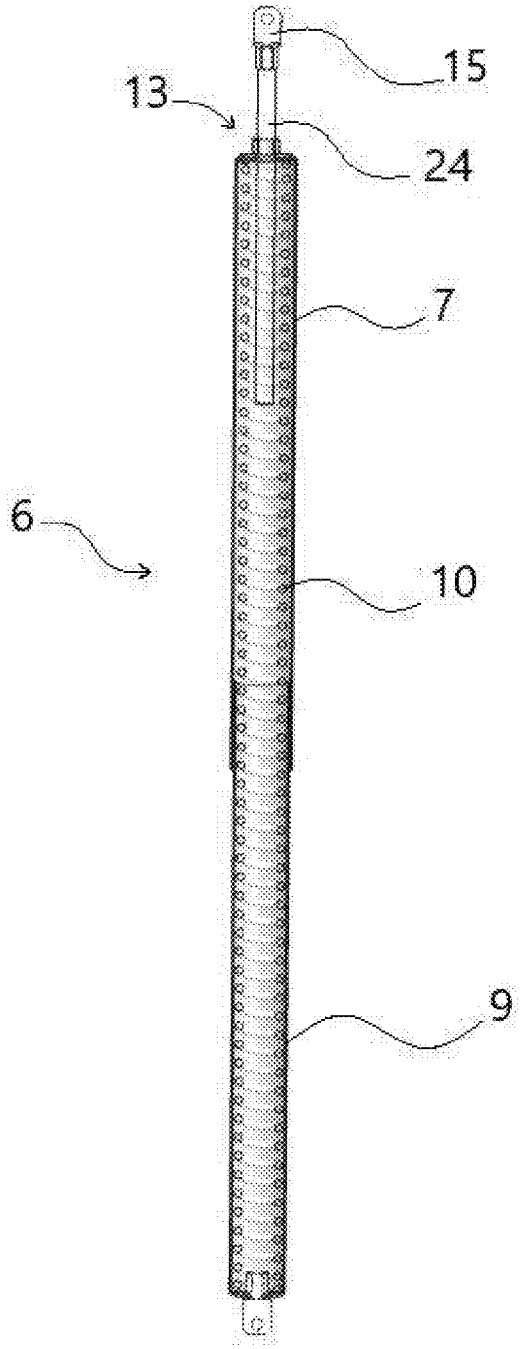

[Fig. 7]
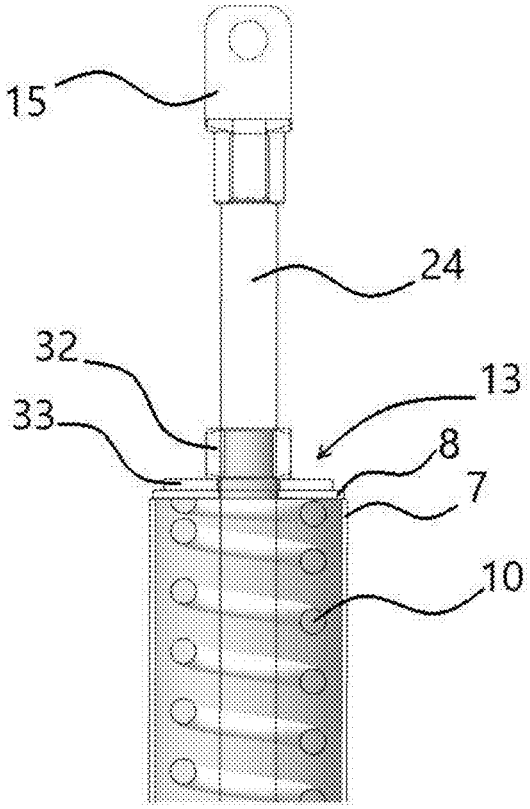

DEVICE FOR ACCESSING AN UNDERGROUND FACILITY, COMPRISING AN ADJUSTABLE ASSISTANCE CYLINDER

CROSS-REFERENCE TO RELATED APPLICATIONS

This application is the US national stage of PCT/FR2022/050066, filed Jan. 13, 2022, which claims the priority of FR 2100431, filed Jan. 18, 2021, and the priority of FR 2111056, filed Oct. 18, 2021. The entire contents of each foregoing application are incorporated herein by reference.

BACKGROUND OF THE INVENTION

Field of the Invention

The present invention relates to the field of devices for accessing underground networks and more generally underground facilities. These access devices can allow visual control of a facility or allow access for a human.

Thus, the access devices cover both "manholes" and "man holes" in the present document.

In particular, the underground facilities include water networks, sewers, communication networks, and buried electrical networks.

Description of the Related Art

The access devices include one or more lid(s), also called buffers or hatches, which may be hinged relative to a frame.

Devices for accessing underground facilities are often made of metal, usually of ductile iron. This type of material offers good resistance to the loads applied on the access device, and also offers the advantage of having a relatively low production cost.

Thus, the access devices with a metal lid, in particular made of cast iron, are particularly well suited to road applications, in particular when vehicles might have to roll over the access device. Nevertheless, their weight could make it preferable, and even necessary, to provide them with a device for assisting opening and closure.

Various assistance devices are known in the prior art. The use of assistance cylinders is common. In general, such a cylinder refers to a device with a generally elongated shape, whose length can vary between a deployed configuration, which it tends to assume in the absence of external loads and wherein it has a maximum length, and a retracted configuration which it adopts under the effect of a longitudinal compression force.

Thus, one (or more) cylinder(s) may be arranged between the lid and the frame of the access device so that the return force of the cylinder, tending to make it adopt the deployed configuration, assists in opening the lid and generates a holding force upon closure thereof.

Several cylinder technologies have been considered to implement the function of assisting in the opening and closure of the lids of devices for accessing underground facilities. Thus, a gas cylinder is the most frequently used one. A gas cylinder includes a cylinder which encloses a gas and a piston which is movable in the cylinder and which compresses the gas when the cylinder is moved towards its retracted position.

However, gas cylinders have some drawbacks. In particular, they have a service life that might be short compared to the desirable duration for some access devices, which could be installed for many years.

A mechanical cylinder is sometimes used as an alternative to a gas cylinder. A mechanical cylinder includes a spring which tends to bring the cylinder into the deployed configuration. This cylinder type is very reliable and has a very long, almost unlimited service life. It may be formed, entirely or partially, of stainless steel, which makes it even more resistant, in particular in humid conditions.

Thus, such a spring cylinder is described for example in the document FR2972476.

Nevertheless, the behaviour of access devices including a mechanical opening assistance cylinder, and in particular their response to load variations, depends on many parameters. These parameters include the weight of the lid, the kinematics of the lid opening mechanism that is used, and the mechanical characteristics of the spring. Yet, with current mass production processes, there is necessarily some dispersion in these parameters.

This results in some disparity in the response of access devices including a mechanical opening assistance cylinder when loads are applied thereto, not only between devices of different references, but also between devices corresponding to the same product reference. This might lead to the generation of "bounce" phenomena of the lid of the device when a significant load is applied thereto and then released, as it happens when a vehicle passes over the lid.

Such a phenomenon, which generates noise and potentially premature wear of the access device, should be avoided.

SUMMARY OF THE INVENTION

Hence, the present invention aims to provide a device for accessing an underground infrastructure, which includes a mechanical cylinder for opening assistance and whose behaviour could be adjusted individually as needed.

Thus, the invention relates to a device for accessing an underground facility which includes a frame forming an opening for accessing the underground facility and a lid pivotally mounted relative to said frame between a closed position in which it closes off all or part of the opening of the frame and an open position in which it enables passage through the opening of the frame. The access device further includes a mechanical cylinder with a helical spring extending according to a so-called longitudinal direction. The cylinder includes a body which can vary in length according to the longitudinal direction according to a longitudinal force which is applied to said cylinder. Thus, the cylinder can vary in length between a retracted configuration and a deployed configuration, the helical spring tending to bring the body of the cylinder into the deployed position. The access device is configured so that the cylinder assists the passage of the lid from the closed position into the open position and exerts on the lid a force opposing closure thereof during passage thereof from the open position into its closed position. According to the present invention, the cylinder includes an adjustable head connected to one end of the body of the cylinder and a mechanism for adjusting the longitudinal position of the head with respect to the body of the cylinder.

The adjustment of the longitudinal position of the adjustable head of the cylinder enable a fine adjustment of the length of the cylinder, whether in the deployed configuration or in the retracted configuration. This length adjustment does not modify the load exerted by the spring. For any intermediate configuration imposed on the cylinder (i.e. for any given cylinder length between its length in the retracted configuration and its length in the extended configuration), the adjustment of the longitudinal position of the adjustable head of the cylinder varies the longitudinal force necessary to impose this intermediate configuration on the cylinder. In other words, for any position of the lid of the access device, this adjustment allows finely adjusting the force imposed by the cylinder on the lid.

Thus, this adjustment allows adapting the response of each device to the external mechanical loads, and compensating for any dispersions in the parameters that influence this response. Thus, the mechanical assistance cylinder can be adjusted so as to obtain the behaviour, i.e. the response to mechanical loads, that is desired for the lid.

In particular, this avoids the generation of bouncing phenomena. Thanks to this adjustment, it is also possible to create a stable semi-open position of the lid, i.e. a position of the lid located between its open position and its closed position in which the actuator holds said lid in position. In particular, the adjustment of the longitudinal position of the head of the cylinder allows adjusting the opening angle of the lid in the semi-open position, within some angle ranges.

The mechanism for adjusting the longitudinal position of the adjustable head with respect to the body of the cylinder may include a tapped element and a corresponding threaded element. The adjustable head then includes one amongst the tapped element and the threaded element, and the body of the cylinder includes the other one amongst the tapped element and the threaded element, so that a rotation of the adjustable head relative to the body of the cylinder modifies the longitudinal position of said adjustable head relative to said body of the cylinder.

The device may further include a lock nut mounted on the tapped element, the lock nut allowing blocking the head once the latter has been brought to a desired longitudinal position.

The adjustment of the longitudinal position of the head using an adjustment mechanism including a tapped element cooperating with a threaded element enables a very accurate and intuitive adjustment of the length of the cylinder. A lock nut allows reliable blocking the adjustable cylinder head once it is in position. The lock nut may be formed by any part mounted on the tapped element.

The end of the body of the cylinder may include a longitudinal threaded orifice and the adjustable head may include a tapped portion mounted in the threaded orifice.

The body of the cylinder may include the threaded element, said threaded element may be attached to the rest of the body of the cylinder and fastened outside a sleeve on an end wall of said sleeve and the head may include a tapped portion mounted in the attached nut. The added threaded element may be an attached nut.

A stiffening washer may be interposed between the attached nut and the wall.

Alternatively, the end of the body of the cylinder may include a longitudinal tapped portion and the adjustable head may include a threaded fitting mounted on said tapped portion.

Thus, different alternative embodiments of the invention may be obtained. Whether the adjustable head includes the tapped portion or the threaded portion of the adjustment mechanism, it is through a relative rotation of the head relative the body of the cylinder, i.e. by screwing or unscrewing, that the longitudinal position of the cylinder head can be adjusted.

The tapped portion may be a tapped rod.

The length-adjustable head may include a flat ear enabling the manual rotation of said adjustable head for adjustment of its longitudinal position.

These are particularly simple and ingenious embodiments.

The body of the cylinder may include a first end to which the adjustable head is connected and a second end, and either the adjustable head is connected to the frame and the second end is connected to the lid, or the adjustable head is connected to the lid and the second end is connected to the frame.

The device for assisting opening of the lid of the access device and for holding said lid when it is closed should exert a force on said lid and take up this force on a fixed element, namely the frame of the access device. Many configurations of the device may be based on this general principle. In particular, one end of the cylinder being connected to a fixed point of the frame, the other end of the cylinder (which may be formed by the adjustable head which is connected to one end of the body of the cylinder) may be connected to a fixed point of the lid.

The cylinder may include a device for adjusting a preload of the spring, and the mechanism for adjusting the longitudinal position of the adjustable head is then independent of the device for adjusting the preload of the spring.

Thus, the position of the adjustable head, and therefore the length of the cylinder, is adjustable independently of a preload exerted by the spring when the cylinder is in the extended configuration.

The invention also relates to a method for installing a device for accessing an underground facility as described before, the method comprising:

installing the device for accessing an underground facility on the opening of a manhole for accessing said underground facility and adjusting the length of the cylinder using the adjustment mechanism.

Thus, the invention enables adjustment of the access device in situ. In fact, the device for accessing an underground facility, object of the present invention, also enables an adjustment after installation of said access device, for example to compensate for wear or backlash of the opening mechanism of the lid or of the cylinder that might have been created over time and restore the desired behaviour of the device. The adjustment thus achieved allows obtaining the desired behaviour of the access device.

Other specific features and advantages of the invention will also become apparent in the following description.

BRIEF DESCRIPTION OF THE DRAWINGS

In the appended drawings, given by way of non-limiting examples:

FIG. 1 shows, according to a schematic three-dimensional view, an example of a device for accessing an underground facility in accordance with an embodiment of the invention;

FIG. 2 shows, according to a block diagram, one end of a cylinder that can be implemented in a device for accessing an underground facility in accordance with an embodiment of the invention;

FIG. 3 shows a variant of the embodiment of FIG. 2;

FIG. 4 shows, according to a schematic three-dimensional view, a cylinder that can be implemented in a device for accessing an underground facility in accordance with an embodiment of the invention;

FIG. 5 shows, according to a schematic sectional view, a cylinder that can be implemented in a device for accessing an underground facility in accordance with an embodiment of the invention;

FIG. 6 shows, according to a schematic sectional view, a cylinder that can be implemented in a device for accessing an underground facility in accordance with an embodiment of the invention;

FIG. 7 shows, according to a partial sectional view, one end of the cylinder of FIG. 6.

DETAILED DESCRIPTION

FIG. 1 shows, according to a schematic three-dimensional view, an example of a device 1 for accessing an underground facility in accordance with an embodiment of the invention. The access device 1 comprises a frame 2 intended to be securely fastened to the ground, to a roadway, or to a fixed construction, and a lid 3. The lid 3 may be a hatch, a buffer, or any other similar covering element.

For example, the frame 2 and the lid 3 may be made of ductile iron or of steel.

The lid 3 is hingedly, in particular pivotally, mounted relative to the frame 2 about a pivot axis A to enable the covering element 3 to pivot between a closed position and an open position.

In the closed position, the lid 3 closes off the opening of the frame 2. In the open position of the lid, the opening of the frame is clear, which allows controlling the underground facility or the access device 1 and/or accessing a check or inspection chimney of an underground network.

The device is shown in FIG. 1 with its lid 3 in the open position. In this position, the lid extends substantially perpendicular to the opening of the frame 2.

When the lid is brought in the closed position, it bears on an inner peripheral seat wall 4 of the frame 2.

A lock, not shown, may be provided to lock the lid 3 in its closed position, i.e. to immobilise it with respect to the frame 2.

The access device 1 includes a cylinder 5. The cylinder 5 is a mechanical cylinder with a helical spring. The cylinder 5 is interposed between the lid 3 and the frame 2, and allows assisting in pivoting the lid 3 from its closed position into its open position.

The cylinder include a body of the cylinder 6 which generally comprises two parts which can be translated longitudinally relative to each other, i.e. in the general direction of extension of the cylinder 5, enabling the cylinder 5 to move from a retracted configuration into a deployed configuration.

In the shown example, the body of the cylinder 6 comprises a cylindrical sleeve 7, one end of which is closed by a wall 8. The body of the cylinder 6 further includes a rigid cylindrical rod 9 adapted to translate in the sleeve 7. A spring 10, namely a helical compression spring is arranged around the rod 9. The rod 9 may be a hollow cylindrical rod.

The spring 10 tends to bring the cylinder 5 into its deployed configuration, in which a first end 11 of the body of the cylinder 6 which is herein formed by the closed end of the sleeve 7 is furthest from a second end 12 of the body of the cylinder 6 which is herein formed by one end of the rod 9 which is outside the sleeve 7. The spring 10 may be mounted preloaded, i.e. it is not completely relieved when the cylinder 5 is in its deployed configuration. According to some embodiments, the cylinder may include a device for adjusting the preload of the spring 10.

In the embodiment shown herein, the first end 11 of the body of the cylinder 6 is equipped with an adjustable head 13 which is detailed with reference to FIG. 4.

The adjustable head 13 is fastened to the inner face of the lid 3 by a pivot axis parallel to the pivot axis A of the lid 3 relative to the frame 2. To this end, the lid 3 is equipped with a clevis or a bell crank 14 (rigid legs including an orifice for receiving a pin) adapted to be linked by a pin to a clevis or a bell crank of the adjustable head 13.

In the embodiment shown herein, the second end 12 of the body of the cylinder 6 is equipped with an end plate forming a clevis 15 including two parallel rigid branches. The clevis 15 is connected to the frame 2 by a pivot with an axis parallel to the pivot axis A of the lid 3 relative to the frame 2. In this case, the clevis 15 is connected to an extension 16 of the frame 2 which is located below the level of the opening formed by said frame 2, and which is itself provided with a corresponding clevis 17.

It is obvious that the present invention may comprise any other arrangement forming a first pivot connection between the first end 11 of the body of the cylinder 6 and the lid on the one hand, and a second pivot connection between the second end of the body of the cylinder 6 and the frame on the other hand.

Moreover, the adjustable head of the cylinder 5 may be connected to the frame 2.

According to various alternative embodiments of the invention, the adjustable head 13 of the cylinder 5 may be located at the first end 11 of the body of the cylinder 6 or at the second end 12 of the body of the cylinder.

Upon closure of the lid 3, the distance between the connection point between the cylinder 5 and the lid 3 on the one hand, and between the cylinder 5 and the frame 2 on the other hand, is reduced as said the lid is closed.

This results in a progressive approach of the ends of the body of the cylinder 6, and a progressive compression of the spring 10. Thus, the spring 10 exerts an increasing force, opposing the closure of the lid 3.

Conversely, upon opening of the lid 3, the ends of the body of the cylinder 6 progressively move apart and the spring 10 progressively decompresses. Thus, the spring 10 exerts a force to assist in the opening of the lid 3.

FIG. 2 shows, according to a block diagram, a cylinder 5 that may be implemented in the invention. The cylinder 5 shown in FIG. 2 is a mechanical actuator with a spring having a different configuration from that one shown in FIG. 1. Thus, the cylinder 5 of FIG. 2 includes a sleeve 7, in which a rod 9 in the form of a hollow tube is partly housed. The rod 9 is movable in translation relative to the sleeve 7. In this embodiment, the spring 10 is thus received in the sleeve 7 and in the hollow tube forming the rod 9.

In the example of FIG. 2, the end of the body of the cylinder 6 formed by the sleeve 7 is provided with a first connection means 18, for example in the form of a clevis 15 or a bell crank 14. The first connection means 18 is adapted to form a pivot connection relative to the lid 3 or the frame 2 of a device 1 for accessing an underground facility.

In turn, the other end of the body of the cylinder 6, formed by the tubular rod 7, includes an adjustable head 13. The adjustable head 13 includes a second connection means 19, for example in the form of a clevis 15 or a bell crank 14. The second connection means 19 is adapted to form a pivot connection relative to the lid 3 or the frame 2 of a device 1 for accessing an underground facility. In particular, in the shown example, the end of the body of the cylinder 6 formed by the rod 9 includes a threaded element 20, forming a threaded bore according to the longitudinal axis of extension of the cylinder 5. In particular, the threaded element 20 is herein formed by a threaded fitting secured to the rod 9, for example attached and welded to the end of said rod 9.

In turn, the adjustable head 13 includes a tapped portion (tapped element 21), adapted to cooperate by screwing with the threaded fitting. Thus, the adjustable head 13 is screwed into the threaded fitting. Thus, screwing or unscrewing of the tapped portion of the adjustable head 13 in the threaded fitting enables the adjustment of the longitudinal position of the adjustable head 13, and therefore the adjustment of the second connection means 19.

A lock nut 22, herein formed by a threaded ring, allows blocking the adjustable head 13 once it has been positioned in the desired longitudinal position.

Of course, the adjustable head described with reference to FIGS. 2 and 3 could have equipped the other end of the body of the cylinder 6, formed by the end of the sleeve 7.

FIG. 3 illustrates an alternative of the actuator of FIG. 2. The cylinder in FIG. 3 is identical to that in FIG. 2, except for the configuration of the adjustable head 13. Hence, reference may be made to the description hereinabove of FIG. 2, except for the connection of the adjustable head 13 to one of the ends of the body of the cylinder.

In the embodiment of FIG. 3, one of the ends of the body of the cylinder 6 (in this case the end formed by the rod 9) thus includes a tapped element 21 in the form of a sleeve whose external surface is tapped, whereas the adjustable head 13 includes a threaded element 20, in the form of a threaded fitting adapted to be screwed onto the tapped fitting of the body of the cylinder.

The lock nut 22 engages the tapped fitting of the body of the cylinder 6.

FIG. 4 shows a cylinder that may be implemented in a device for accessing an underground facility in accordance with an embodiment of the invention. In particular, FIG. 4 corresponds to the end connected to the lid 3 of the cylinder illustrated in FIG. 1.

In this embodiment, a threaded orifice is made in the wall 8 which closes off one end of the sleeve 7 (shown in section according to a plane parallel to the main longitudinal axis of the cylinder 5). The threaded orifice continues in a boss 23 internal to the sleeve 7 (for example formed by an attached and welded washer), which increases the length of the threaded orifice and can contribute to the proper holding of the spring 10 in position (not shown in FIG. 4).

The adjustable head 13 includes a tapped element in the form of a tapped rod 24, which may optionally include a hexagonal head 25 (or other) enabling screwing and unscrewing thereof using conventional tools.

The adjustable head 13 includes a bell crank 14, in the form of a flat ear 26 rigidly fastened to the tapped rod 24 and including a bore 27 enabling the passage of an axis for the formation of a pivot connection with the lid 3 or the frame 2. To some extent, this flat ear 26 allows to manually screwing or unscrewing the adjustable head 13.

The lock nut 22 is herein formed by a conventional hexagonal nut, adapted to the tapped rod 24. It bears on the wall 8 on which it is clamped when the adjustable head 13 has been brought to the desired longitudinal position.

In the embodiment shown in FIG. 4, the adjustable head 13 is located at the end of the body of the cylinder 6 formed by the sleeve 7. Of course, it could alternatively be located at the end of the body of the cylinder 6 formed by the rod 9. In this case, the configuration of the adjustment mechanism may be completely identical to that one shown in FIG. 4 if the rod 9 is hollow. If the rod 9 is solid, the threaded orifice may be a blind hole.

Thus, the embodiment shown in FIG. 4 allows making a head whose longitudinal position is adjustable, in a simple, economical and efficient manner.

FIG. 5 shows, according to a schematic sectional view, a cylinder that can be implemented in a device for accessing an underground facility in accordance with an embodiment of the invention. In particular, FIG. 5 illustrates that a mechanical cylinder of the type described by the document FR2972476 can be adapted so that it includes an adjustable head allowing making an access device in accordance with the present invention.

The cylinder 5 of FIG. 5 is shown in the deployed configuration (on the left of FIG. 5) and in the retracted position (on the right of FIG. 5). The mechanical cylinder of FIG. 5 includes the particularity that the rod 9 comes out through a hole formed in the end wall 8 of the sleeve 7 as the cylinder is compressed. Thus, although the overall length of the cylinder remains unchanged during the compression of the cylinder 5, the distance between the first end 11 of the body of the cylinder 6 formed by one end of the sleeve 7 and the second end 12 of the body of the cylinder 6 formed by the opposite end of the rod 9 is reduced during the compression of the cylinder 5.

With such a cylinder configuration 5, an adjustable head may nevertheless be provided. It may be provided at the second end 12 of the body of the cylinder 6 formed by the rod 9, according to any one of the embodiments previously described with reference to FIGS. 2 to 4.

Alternatively, it may be provided at the first end 11 of the body of the cylinder 6, as shown in FIG. 5. In the shown example, the adjustable head 13 is similar in principle to that one shown in FIG. 3. The adjustable head 13 includes a threaded element 20 in the form of a sleeve connected to the sleeve 7 by screwing onto a tapped element 21, itself in the form of a sleeve whose external surface is tapped. Of course, the reverse configuration could have been adopted, with a threaded fitting fastened to the end of the sleeve and a tapped fitting formed on the adjustable head 13, the sleeve of the adjustable head being screwed into the threaded fitting of the sleeve 7.

However, the fitting of the adjustable head 13 should include a central bore 28 enabling the passage of the rod 9.

The adjustable head 13 includes a means for connection to the lid 3 or to the frame 2 of the access device, namely herein a clevis 15 including two parallel branches. Because of the sectional illustration, one single branch of the clevis 15 is shown in FIG. 5 in the deployed configuration of the cylinder 5 (shown on the left of FIG. 5) while this branch of clevis 15 is masked by rod 9 in the retracted configuration of the cylinder 5 (shown on the right of FIG. 5).

In the example of a cylinder shown in FIG. 5, the rod 9 is provided with a preload adjustment device 29, allowing adjusting the preload of the spring 10. The preload adjustment device 29 includes a screw 30 and a nut 31. It should be noted that the mechanism for adjusting the adjustable head position 13 is independent of the adjustment of the preload. Thus, the mechanism for adjusting the longitudinal position of the head with respect the body of the cylinder enables the adjustment of the longitudinal position of the adjustable head 13, and consequently the adjustment of the length of the cylinder 5 measured between the means for fastening the cylinder to the lid 3 and the means for fastening to the frame 2, without modifying the load exerted by the spring 10. Thus, in the deployed configuration of the cylinder 5, it is possible to independently adjust the preload of the spring 10 on the one hand, and the longitudinal position of the adjustable head 13 on the other hand. More generally, the mechanism for adjusting the longitudinal position of the head with respect to the body of the cylinder is independent of the spring of the cylinder.

The embodiments of the invention are described as example, and it should appear to a person skilled in the art that some modifications could be made thereto without departing from the scope of the present invention.

In particular, it is possible to provide two assistance cylinders 5 (or more than two), to assist the opening of the lid of an access device according to an embodiment of the invention. Similarly, an access device may include several lids, each lid being equipped with one or more cylinder(s) 5. Moreover, the frame 2 and the lid 3 may have various shapes, in particular rectangular or square, as shown in FIG. 1, or circular.

FIG. 6 shows, in a sectional view, a cylinder that can be implemented in a device for accessing an underground facility in accordance with another embodiment of the invention.

The cylinder of FIG. 6 includes a sleeve 7, in which a rod 9 is partly housed which is in the form of a hollow tube, i.e. itself forming a sleeve for the elements it includes. The rod 9 can slide in sleeve 7, with a relatively small functional clearance between the inside of sleeve 7 and the external surface of the rod 9. Dust sealing means may be provided between the sleeve 7 and the rod 9.

A spring 10, namely a helical spring, advantageously adapted to work in compression, is received in the sleeve 7 and in the hollow tube forming the rod 9.

In the embodiment shown in FIG. 6, the adjustable head 13 is located at the end of the body of the cylinder 6 formed by the sleeve 7. Of course, it could alternatively be located at the end of the body of the cylinder 6 formed by the rod 9, or an additional adjustable head could be provided at this end of the body of the cylinder 6.

To the extent that the rod 9 also forms a sleeve, the configuration of an adjustment mechanism made at the end of the rod 9 may be identical to that one shown in FIG. 7 described hereinafter.

Thus, FIG. 7 shows, in a partial sectional view, one end of the cylinder of FIG. 6. More particularly, FIG. 7 shows the end of the cylinder of FIG. 7 intended to be connected to the lid 3 and formed in the shown example at the end of the cylinder 6 formed by the sleeve 7.

In the shown embodiment, an attached nut 32 forms a threaded element outside the wall 8 which closes off one end of the sleeve 7 of the cylinder. A washer 33 reinforces the support area on the wall 8.

Advantageously, the washer 33 is fastened, for example welded, to the wall 8. The attached nut 32 is fastened, advantageously welded, to the washer 33.

In this embodiment, a tapped rod of a tapped rod 24 is screwed into the attached nut 32. A clevis 15 is screwed at the end of the tapped rod 24 outside the sleeve 7. The clevis 15 is adapted to be linked, by an axis, to a corresponding bell crank present on the lid 3.

The tapped rod may be relatively long, enabling adaptation of the cylinder to many applications, while also enabling a fine adjustment of its length. Its section is adapted to the bending stresses that it might undergo.

The adjustment over a large range of the length of the cylinder 6 (the length of the cylinder 6 being considered when the latter is not subjected to external stresses), also enables an adjustment over a large range of the opening assist level and the level of the retaining level when closing the lid 3 offered by the cylinder.

As shown in FIG. 6, in the example shown a fixed clevis is attached, for example screwed or welded, to the end of the cylinder formed by the rod 9.

Thus, the access device developed in the invention allows, thanks to at least one length-adjustable cylinder (by modifying the longitudinal position of an adjustable head), a fine adjustment of the behaviour of said access device. This allows adapting the cylinder(s), which are pre-dimensioned elements, to a specific application, i.e. to a device for accessing a given underground facility. This also allows compensating for the dispersions related to the manufacture of the springs, the manufacture of the lids (in particular with regards to mass dispersions), and the assembly of the access device. The present invention can also enable a fine adjustment once the access device is installed. It also allows compensating, where appropriate, for wear of the components of the access device.

In particular, such a fine adjustment allows limiting or suppressing the phenomena of bouncing of the lid caused by the assistance cylinder following a significant variation in the load on the access device (for example caused by the passage of a vehicle on the access device). Finally, the present invention allows creating a stable semi-open position of the lid and/or adapting the opening angle of the lid in such a semi-open position. Such a semi-open position may allow facilitating gripping of the lid with to fully open it, or to form a position for the temporary passage of cables, or ventilation of the underground facility, etc.

The solution proposed in the invention is easily adaptable and has a low production cost.

The invention claimed is:

1. A device for accessing an underground facility, the device comprising:

a frame forming an opening to access the underground facility;

a lid pivotally mounted relative to said frame between a closed position in which the lid closes off all or part of the opening of the frame and an open position in which the lid allows passage through the opening of the frame; and a mechanical cylinder with a helical spring extending according to a longitudinal direction, the mechanical cylinder including a body which varies in length according to the longitudinal direction according to a longitudinal force which is applied to said mechanical cylinder, between a retracted configuration and a deployed configuration, the helical spring being configured to bring the body of the mechanical cylinder into the deployed position, the mechanical cylinder further including an adjustable head connected to one end of the body of the mechanical cylinder and an adjustment mechanism configured to adjust a longitudinal position of the adjustable head with respect to the body of the mechanical cylinder, the body of the mechanical cylinder including a first end to which the adjustable head is connected and a second end, one of the adjustable head and the second end is connected to the frame and the other of the adjustable head and the second end is connected to the lid, wherein the mechanical cylinder is configured to assist passage of the lid from the closed position to the open position and exert on the lid a force opposing closure thereof during passage thereof from the open position to the closed position.

2. The device according to claim 1, wherein the adjustment mechanism includes a tapped element and a corresponding threaded element, the adjustable head including one of the tapped element and the threaded element, and the body of the mechanical cylinder including the other one of the tapped element and the threaded element, so that a rotation of the adjustable head relative to the body of the mechanical cylinder modifies the longitudinal position of said adjustable head relative to said body of the mechanical cylinder.

3. The device according to claim 2, further comprising a lock nut mounted on the tapped element, the lock nut being configured to allow blocking the adjustable head.

4. The device according to claim 2, wherein the end of the body of the mechanical cylinder has a longitudinal threaded orifice and the head includes a tapped portion mounted in the threaded orifice.

5. The device according to claim 2, wherein the body of the mechanical cylinder includes the threaded element attached to the body of the mechanical cylinder and fastened to the outside of a sleeve on an end wall of said sleeve, and the head includes a tapped portion mounted in said attached part.

6. The device according to claim 5, wherein said threaded element is an attached nut.

7. The device according to claim 6, wherein a stiffening washer is interposed between the attached nut and the wall.

8. The device according to claim 2, wherein the end of the body of the cylinder includes a longitudinal tapped portion and the head includes a threaded fitting mounted on said tapped portion.

9. The device according to claim 4, wherein said tapped portion is a tapped rod.

10. The device according to claim 2, wherein the length-adjustable head includes a flat ear enabling manual rotation of said head for adjustment thereof in the longitudinal position.

11. The device according to claim 1, wherein the mechanical cylinder includes an adjustment device configured to adjust a preload of the spring, and wherein the adjustment mechanism is independent of the adjustment.

12. A method of installing the device according to claim 1, the method comprising:

placing the device on an opening of a manhole to access said underground facility; and adjusting a length of the mechanical cylinder using the adjustment mechanism.

13. The device according to claim 3, wherein the end of the body of the cylinder has a longitudinal threaded orifice and the head includes a tapped portion mounted in the threaded orifice.

14. The device according to claim 3, wherein the end of the body of the cylinder includes a longitudinal tapped portion and the head includes a threaded fitting mounted on said tapped portion.

15. The device according to claim 5, wherein said tapped portion is a tapped rod.

16. The device according to claim 6, wherein said tapped portion is a tapped rod.

17. The device according to claim 7, wherein said tapped portion is a tapped rod.

18. The device according to claim 8, wherein said tapped portion is a tapped rod.

19. The device according to claim 3, wherein the length-adjustable head includes a flat ear enabling manual rotation of said head for adjustment thereof in the longitudinal position.

* * * * *